United States Patent [19]

Mulic

[11] 4,095,689

[45] Jun. 20, 1978

[54] SAFETY PACKAGE FOR MATCHES

[76] Inventor: Richard J. Mulic, 237 Cecil St. SE., Minneapolis, Minn. 55414

[21] Appl. No.: 860,584

[22] Filed: Dec. 14, 1977

Related U.S. Application Data

[63] Continuation-in-part of Ser. No. 825,672, Aug. 18, 1977, abandoned.

[51] Int. Cl.[2] ..... A24F 27/12; A24F 27/00; A24F 27/18

[52] U.S. Cl. ..... 206/106; 206/109; 206/115

[58] Field of Search ..... 206/109, 106, 108, 107, 206/115, 114

[56] References Cited

U.S. PATENT DOCUMENTS

| | | | |
|---|---|---|---|
| 2,935,185 | 5/1960 | Will | 206/108 |
| 3,982,629 | 9/1976 | Duenke | 206/106 |
| 4,040,516 | 8/1977 | Cappello | 206/109 |

*Primary Examiner*—William T. Dixson, Jr.
*Attorney, Agent, or Firm*—Merchant, Gould, Smith, Edell, Welter & Schmidt

[57] ABSTRACT

An improved package for matches is disclosed, in which the striking surface of the package is protected by a flattenable, generally tubular enclosure. The enclosure hides the striking surface from view, and prevents a match from being struck unless it is pinched between the striking surface and the interior wall of the enclosure as it is drawn across the striking surface.

The tubular enclosure may include a front cover receiving recess, and normally be in a flattened position, whereby a sliding motion of the front cover towards the tubular enclosure while in engagement with the receiving recess expands the tubular enclosure allowing access to the striking surface.

2 Claims, 9 Drawing Figures

SAFETY PACKAGE FOR MATCHES

BACKGROUND OF THE INVENTION

RELATED APPLICATIONS

This application is a continuation-in-part of copending patent application Ser. No. 825,672, filed Aug. 18, 1977, now abandoned.

FIELD OF THE INVENTION

This invention relates generally to the field of packages for matches, and more particularly concerns safety packages adapted to prevent children from inadvertently striking cardboard matches thereon.

DESCRIPTION OF THE PRIOR ART

The potential disasters engendered when young childern, particularly in the age group of one to four years old, play with matches are well known and feared by parents. Heretofore, however, there has not been developed a package for cardboard matches which is designed to defeat a young child's efforts to produce a flame by striking a match from a package which he has come across in his interminable searching and wandering.

The only pertinent prior art of which applicant is aware is the well-known matchbook comprising a deck of cardboard matches attached to a base along a perforated line, and a cardboard cover is folded so as to provide a back portion, an upturned lip, and front flap. The base of the match deck is interposed between the lip and back portion and secured there with a staple extending through the lip, base and back. The front flap portion is openable and closable by tucking its free end between the lip and the match deck base. In most such matchbooks, a striking strip is provided on the front, presented surface of the lip portion of the cover. The striking strip is comprised of a layer of an appropriately abrasive material affixed to the cardboard cover material, which generally has a non-abrasive, decorative finish. The striking strip is usually in a contrasting color to the remainder of the cover—usually the strip is a very dark brown—and is completely accessable.

The only "safety features" provided with such matchbooks are the fact that the cardboard matches contained therein may only be struck on the provided striking strip, and the familiar legend printed on the match cover, "Please close cover before striking".

The accessability and noticeability of the match striking strip, together with the ease with which the cover may be opened and the matches obtained, make such matchbooks hazardous in the hands of inquisitive children. After having seen an adult open the cover, pull out a match and draw the colorful head of the match across the dark, abrasive strip to produce a flame, a curious child will find it relatively easy to emulate those actions when given the opportunity to pick up such a book of matches carelessly left lying about. The potential danger goes without saying.

It is an object of the invention herein disclosed to provide means for striking matches which are not easily used by young children, and which require more than casual observance of an adult utilizing the striking means in order for a child to successfully strike a match himself.

It is a further object of the invention to combine the striking means with a standard matchbook to produce an improved, safe matchbook, which is also an inexpensive-to-produce article of manufacture.

SUMMARY OF THE INVENTION

In accordance with the present invention, the abrasive, match-striking strip is provided with a cover flap extending longitudinally thereof. By this arrangement, a two-fold safety factor is accomplished. First, the dark colored, abrasive strip is hidden from the view of a child either observing an adult's use of the invention, or playing with it himself: he cannot see what it was that the adult struck his match on, and consequently, will have difficulty striking a match himself. Second, the striking strip, being covered, is not easily accessable to a child's random poking and prodding with an unspent match, and, therefore, accidental striking of a match is much less likely than with the common matchbook presently in use. The only way a match can be struck with the present article of manufacture is by placing the unspent match end in the recess formed between the safety flap and the striking strip—a deliberate action which is likely to be beyond the dexterity of a large number of small children.

By constructing the inventive article so that the material used and the transverse dimensions of the match-covering cavity bounded by the walls of the protective "tube" are such that insufficient friction can be generated by simply placing a match head in contact with the striking strip and moving it back and forth, another safety feature is achieved. To strike a match placed in such a cavity, the match head must be pinched between the striking strip and the inside surface of the safety flap with one hand as it is drawn out of the cavity with the other. This pinching action is carried out rapidly and is virtually unnoticeable to a child observing it, thus, not only will a child have trouble emulating the action, the limits of his dexterity and strength will also deter him from efficiently copying the requisite motion.

Finally, the "tubular" striking means can be easily and cheaply manufactured simply by extending the upturned lip portion of the presently known matchbooks, and making several easy folds in the extension material to define a safety flap. The matchbook is completed by a staple extending through the lip, match deck base, and back portion of the cover. The vastly improved safety cover herein disclosed can be manufactured with little or no change in the presently used method of manufacture.

It will be appreciated that an effective safety package for matches has been disclosed which hinders a child's observation of the method of striking matches, prevents accidental striking of a match randomly contacted with the package, and which requires that several deliberate steps be taken before a match may be struck, which steps are beyond the ability of most young children to perform due to limits on their strength and dexterity.

These and other features of the invention will be discussed in more detail in the following sections.

DESCRIPTION OF THE PREFERRED EMBODIMENT

Figure 2:
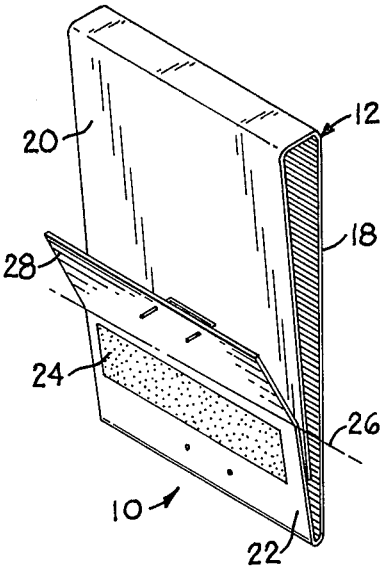
FIG. 2 is a view in perspective of the article of manufacture of the present invention, with the safety flap folded back so as to reveal the striking strip.

Referring now to FIG. 2, there is shown an improved, safe matchbook 10, constructed in accordance with the present invention. As in conventionally known matchbooks, matchbook 10 comprises a cardboard cover 12, enclosing a plurality of cardboard matches 14 (shown in FIGS. 3 and 4) which are perforatedly attached to one or two cardboard base members 16. Cover 12 includes a back portion 18, a front flap 20, and an upturned lip portion 22. Affixed or coded, on the front presented surface of lip portion 22 is a match-striking strip 24. Striking strip 24 may be of sandpaper or emery paper, or some other suitable abrasive material which is well-known in the art. As opposed to the rough texture of strip 24, the remaining surfaces of cover 12 are generally smooth, and often polished and printed with decorative material, so that a match may only be struck on strip 24.

On a conventional matchbook, lip 22 terminates at the edge indicated by fold line 26, and front cover flap 20 is tucked between lip 22 and the base or bases 16 to secure the flap in a closed position. In the present invention, a safety flap 28 extends from lip 22, as shown in FIG. 2. Safety flap 28 is folded down along fold line 26 and secured to lip portion 22 by means of staple 30 which extends through flap 28, lip 22, base or bases 16 and back 18.

Figure 1:
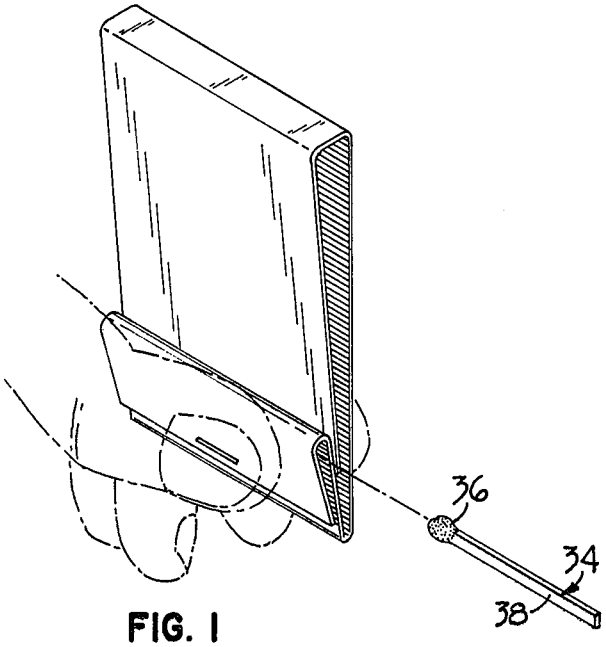
FIG. 1 is a view in perspective, indicating the proper use of a matchbook constructed in accordance with the present invention.

By folding flap 28 over and securing it to lip portion 22, a generally tubular structure is achieved, whereby striking strip 24 is situated within a longitudinally extending, match-receiving cavity 32, which is open at both ends to facilitate insertion of a match 34 therein, as indicated in FIG. 1. It will be appreciated that flap 28 could be secured to lip 22 by means other than a staple—glue, for instance, would be appropriate—or that a continuous tubular wall-something on the order of that provided by a soda straw—having a striking portion on the interior wall would be within the scope of my invention. However, the preferred form, especially for the purpose of ease of manufacture, is the flap and staple arrangement shown in the drawings.

Cavity 32 extends, in longitudinal dimension, over the length of striking strip 24. In its transverse dimensions, cavity 32 must be such that, when a match is inserted therein, with its head resting against striking strip 24, there will be no appreciable force exerted by the interior wall of flap 28 tending to press match head 36 against strip 24. In general, this means that cavity 32 is slightly larger in transverse dimension than the corresponding dimensions of the matchhead portion 36 of match 34. This dimensioning allows match 34 to be easily inserted into cavity 32; it also ensures that there is not such a tight fit of the match between the interior wall of flap 28 and striking strip 24 that sufficient striking friction can be generated by simply pulling the match out of the match receiving space.

Since cardboard matches are not very rigid in their construction, there is also no way to "lever" matchhead 36 against strip 24 by applying a moment around the shaft portion of match 34 while it is inserted in space 32—such a moment would only buckle the shaft of match 34. Consequently, the only way in which sufficient striking friction can be generated is to insert match 34 into cavity 32, and pinch matchhead 36 between flap 28 and strip 24 as it is drawn out of cavity 32. This operation is illustrated in FIG. 1. As there suggested, the requisite striking action requires use of both hands, and a level of dexterity, coordination, and timing, which, although simple for adults to master, is beyond the capabilities of most children in the age group which is the target of the invention.

Figure 4:
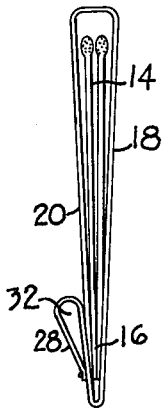
FIG. 4 is a view similar to that shown in FIG. 3 of the match cover with safety flap spaced apart from striking strip.
Figure 3:
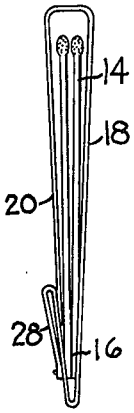
FIG. 3 is a view in end elevation of a matchbook constructed in accordance with the present invention as it appears with safety flap flattened against striking strip.

To accomplish the pinching of the matchhead, safety flap 28 is flattenable against lip 22, and strip 24 and illustrated in FIGS. 3 and 4. This is primarily due to the generally non-rigid characteristic of the cardboard used in the construction of cover 12. This "flattenability" could be accomplished by other means with other materials, however—by scoring, hinging, spring-biasing, etc.

Referring to FIGS. 5–9 a second embodiment of the present invention is shown. The matchbook 10′ of this embodiment includes a cardboard cover 12′ enclosing a comb of matches 14′, having a base member 16′. Cover 12′ comprises a back cover portion 18′ attached to a front cover portion 20′ by means of a hinge portion 21′, which not only allows front cover 20′ to be opened, but also provides for a sliding motion of front cover 20′ between the first and second position shown in FIG. 9. An upturned lip 22′ curls around base member 16′, and a staple 30′ extends through lip 22′, base 16′ and back cover 18′ to secure the match comb 14′ within cover 12′.

Figure 5:
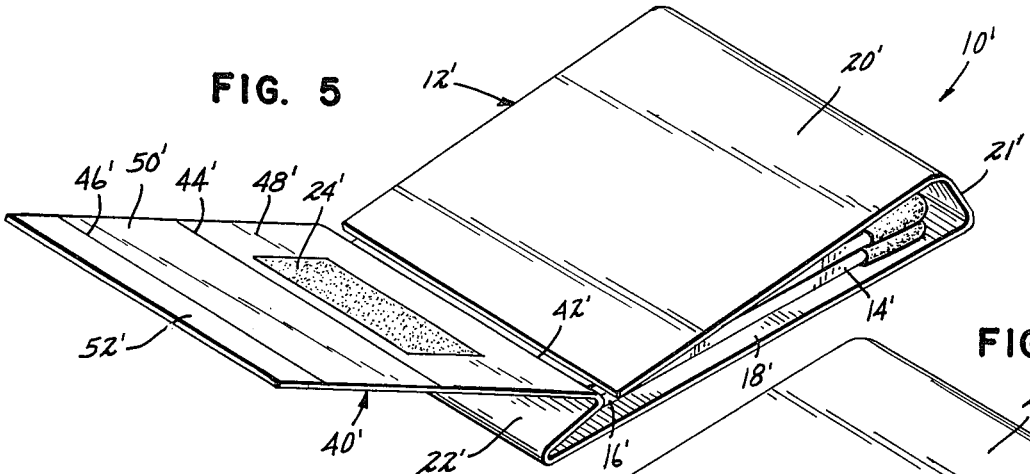
FIG. 5 is a view in perspective of another embodiment of the invention, showing the safety flap in its unfolded state.
Figure 6:
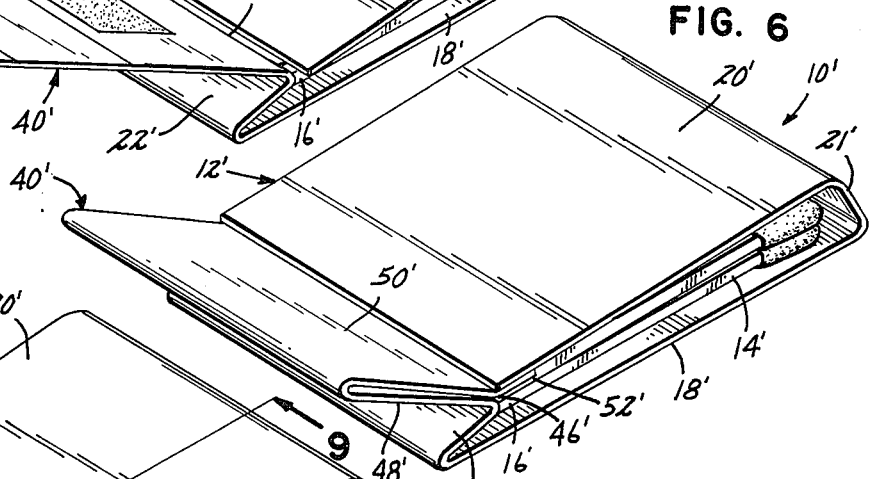
FIG. 6 is a view similar to that shown in FIG. 5 with the safety flap partially folded.
Figure 7:
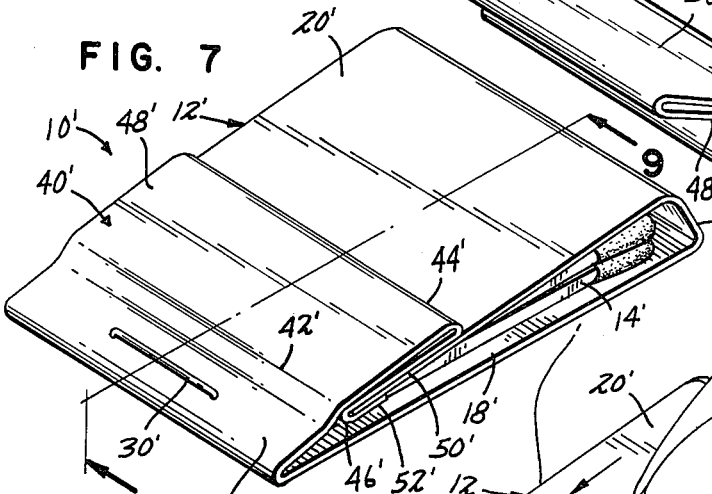
FIG. 7 is a view similar to that shown in FIGS. 5 and 6 with the safety flap folded and in its normal, flattened position.
Figure 8:
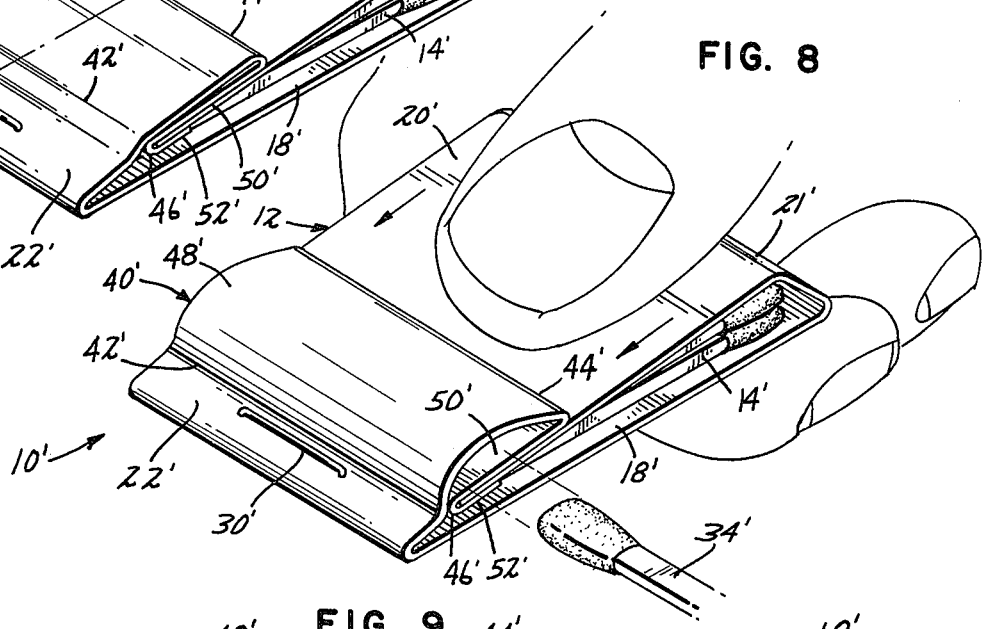
FIG. 8 is a view in perspective showing the operation of the invention.
Figure 9:
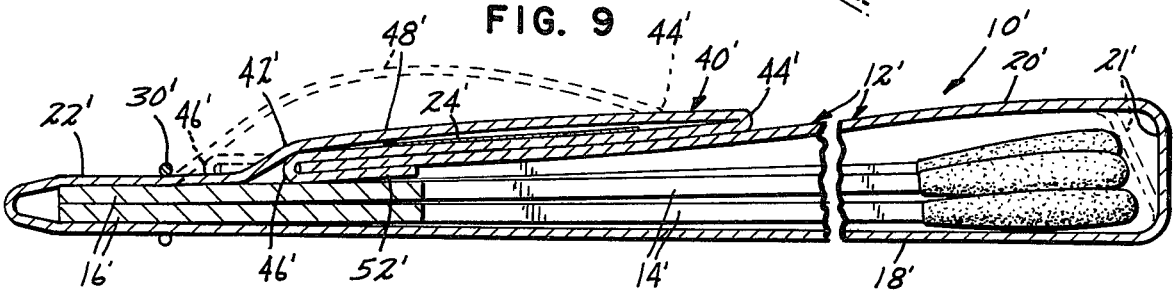
FIG. 9 is an enlarged sectional view of the invention as seen from the line 9—9 of FIG. 7 showing its normal position in solid lines, and indicating its second, use position in dotted lines.

Cover 12′ further comprises a safety flap portion 40′ extending from lip 22′ above the staple point. Safety flap 40′ is folded along fold lines 42′, 44′ and 46′ as shown in FIGS. 5, 6 and 7 in a "reverse-S" manner to define panels 48′ and 50′, and second upturned lip 52′. Striking strip 24′ may be mounted on the interior surface of panel 48′, as shown in FIG. 5, or on the interior surface of panel 50′ (not shown). Upturned lip 52′ and panel 50′ cooperate to define a receiving groove for front cover 20′, as is best shown in FIGS. 7–9.

Safety flap 40′, when folded, is normally in the flat position shown in FIG. 7, whereby there is no access to striking strip 24′. A sliding movement of front cover 20′, as shown in FIG. 8 to a second position, bulges panel 50′ outwardly to define a generally tubular member, thus giving access to striking strip 24′. This sliding action is best shown in FIGS. 8 and 9. With panel 48′ bulged outwardly, a match 34′ may be inserted in the longitudinal, flattenable cavity defined by panels 48′ and 50′, and struck as previously described.

It will be appreciated that the addition of a safety flap over the striking strip of a conventional matchbook—an inexpensive operation requiring no additional parts and very few modifications in the present method of manufacture—provides several extremely beneficial safety factors. First, the striking surface of the match cover and the entire striking operation are effectively hidden from the casual observance of a young child watching an adult strike a match. Second, the striking strip is covered so that a child who picks up the book cannot accidentally strike a match on an easily accessable, exposed surface of the book. Third, the presence of the open ended tube formed by the safety flap in the lip portion requires that a match be held between thumb and forefinger and inserted longitudinally therein in order for the match head to be brought into contact with the striking strip; this step requires manual dexterity and hand-eye coordination that very young children may not have developed, thus precluding their being able to strike a match on the safety package. Finally, the dimensions of the tube formed by the safety flap—particularly the transversely measured distance between the interior surface of the safety flap and the striking surface are such that a match head once inserted into the tube, must be pinched between the flap and striking strip by exerting a force on the outside surface of the flap with the fingers of one hand, while drawing the match rapidly across the strip and from the tube with the other hand—an easily disguised motion which a child may not learn by casual observance, and a difficult-to-perform step for a young child with limited strength and dexterity.

All of their safety features previously described are present in this embodiment of the invention. In addition, a further step of bulging the safety flap by sliding the cover is required, so as to further hamper a child's attemp to strike a match, and, also, if safety flap 40' should for some reason be torn from the matchbook 10', the striking strip 24' will also be removed, thus rendering the remaining assembly strike proof.

What is claimed is:

1. An improved safety cover for cardboard matches comprising:

(a) a front cover portion terminating a first lower edge, (b) a back cover portion terminating at a second lower edge, (c) means for hingeably attaching said front cover with said back cover, (d) a first upturned lip portion extending from said second lower edge, (e) a safety member extending from said first upturned lip portion including striking strip covering means defining first and second deformable surfaces resiliently secured to each other, and movable between a first position wherein said surfaces are in a flattened, overlying relationship, and a second position wherein said surfaces are opened away from each other to define a generally tubular member having an open match receiving end, said striking strip covering means normally being in said first position, and including a second upturned lip portion which cooperates with said second deformable surface to define a seating groove for said lower edge of the front cover, (f) a match-striking strip affixed to one of said deformable surfaces interiorly of said tubular member; and (g) a staple extending through said first upturned lip portion and said back cover.

whereby when the lower edge of the front cover is engaged in the seating groove, the striking strip covering means can be moved from its normal, flattened position to its open, tubular position by exerting a force on the front cover to shift the front cover towards the staple.

2. A safety matchbook comprising:

(a) at least one comb of matches, (b) a cover including (i) a front cover portion with a lower edge, (ii) a back cover portion hingeably attached to the front cover portion, and (iii) an upturned lip portion extending forwardly from the back cover portion, (c) a staple extending through said upturned portion, said comb of matches, and said back cover portion; and (d) a safety flap extending from said upturned portion above the position of the staple, said safety flap including:

(i) a flap of cardboard folded on itself in a "reverse S-curve" configuration defining an outer tube and an inner, front cover edge-receiving groove; and (e) a match striking strip affixed interiorly of said outer tube.

* * * * *